US008755705B2

(12) United States Patent
Nakahara et al.

(10) Patent No.: US 8,755,705 B2
(45) Date of Patent: Jun. 17, 2014

(54) IMAGE HEATING APPARATUS

(75) Inventors: Hisashi Nakahara, Numazu (JP); Kentaro Yamashita, Suntou-gun (JP)

(73) Assignee: Cannon Kabushiki Kaisha, Tokyo (JP)

( * ) Notice: Subject to any disclaimer, the term of this patent is extended or adjusted under 35 U.S.C. 154(b) by 183 days.

(21) Appl. No.: 13/471,927

(22) Filed: May 15, 2012

(65) Prior Publication Data

US 2012/0294641 A1 Nov. 22, 2012

(30) Foreign Application Priority Data

May 19, 2011 (JP) ..... 2011-112763

(51) Int. Cl.
*G03G 15/20* (2006.01)

(52) U.S. Cl.
USPC ..... 399/69; 399/328; 399/329

(58) Field of Classification Search
USPC ..... 399/38, 67–70, 320, 328, 329; 219/216, 219/619
See application file for complete search history.

(56) References Cited

U.S. PATENT DOCUMENTS 5,450,180 A 9/1995 Ohzeki et al.
7,203,438 B2 4/2007 Omata et al.
7,254,352 B2 * 8/2007 Lee ..... 399/69
7,310,485 B2 * 12/2007 Peng et al. ..... 399/69
7,368,687 B2 * 5/2008 Kagawa ..... 219/619
7,546,050 B2 * 6/2009 Kishi et al. ..... 399/69
2011/0236090 A1 9/2011 Uchiyama et al.
2012/0020709 A1 1/2012 Uchiyama et al.

FOREIGN PATENT DOCUMENTS

JP 2-123385 A 5/1990
JP 3535529 A 6/2004

* cited by examiner

*Primary Examiner* — Hoan Tran
(74) *Attorney, Agent, or Firm* — Fitzpatrick, Cella, Harper & Scinto

(57) ABSTRACT

An image heating apparatus for heating a toner image in a nip while conveying a recording material on which the toner image is held is provided. The image heating apparatus includes: a heater configured to generate heat by being supplied with electric power from an AC power source; a rotatable heating member configured to be heated by the heater; a pressing member configured to form the nip in contact to the rotatable heating member; a temperature detecting portion configured to detect a temperature of the heater or the rotatable heating member; and a controller configured to set the electric power supplied to the heater every renewal cycle depending on a detected temperature by the temperature detecting portion. The renewal cycle is shorter in a rise period of the heater than in a period in which the recording material is conveyed in the nip.

4 Claims, 3 Drawing Sheets

IMAGE HEATING APPARATUS

FIELD OF THE INVENTION AND RELATED ART

The present invention relates to an image heating apparatus.

As a conventional image heating apparatus of an image forming apparatus of an electrophotographic type, the image heating apparatus of a heating roller type has been widely used. In the image heating apparatus of the heating roller type, a recording material on which an unfixed toner image is carried is passed through a fixing nip formed by a fixing roller and a pressing roller which rotate in press-contact to each other, so that the toner image is fixed on the recording material. Further, in recent years, as the image heating apparatus, the image heating apparatus of a film-heating type capable of realizing a quick temperature rise even when there is suppression of electric power consumption during a stand-by state has been put into practical use.

In these image heating apparatuses, when electric power supplied to a heater is controlled, there is a need to control the heater so as not to cause excessive overshooting or undershooting of a temperature of the heater with respect to a target temperature or so as not to cause an occurrence of a large ripple. For that purpose, as control of electric power supplied to the heater, in some cases, PI control (proportional integral control) or PID control (proportional integral and differential control) is employed. By the PI controller and the PID control, a duty of turning-on of the heater (ON-time) is determined, and depending on the determined duty, energization control of a switching element is effected to carry out the electric power control.

As a type of the energization control, there are an image-number-control type and a phase-control type. The image-number-control type will be described below.

The image number control is such that ON/OFF control is effected every (one) half-wave of an AC voltage to be inputted, wherein a group of half-waves is used as a predetermined cycle (period) and the ON-duty (ON-time) is controlled by an energization ratio between ON/OFF in the predetermined cycle.

For example, when a power source frequency of an AC power source is 50 Hz, one half-wave is 10 msec. In the case where a group of 20 half-waves (200 msec) is used as the predetermined cycle, electric power supplied to the heater is renewed. Minimum electric power is all-OFF (of the 20 half-waves), and maximum electric power is all-ON (of the 20 half-waves). A supply electric power amount for each cycle of renewal (renewal cycle) of the electric power supplied to the heater has 21 levels from ON of 0 half-waves (no half-wave) to ON of 20 half-waves.

The optimum setting of the renewal cycle for which the electric power supplied to the heater is renewed is different depending on constitution of the image heating apparatus and the image forming apparatus similarly as in the case of the ON-duty parameter. Further, in each constitution, the optimum renewal cycle is also different depending on whether the period is a period in which a recording material is not conveyed in a nip of the image heating apparatus or a period in which the recording material is conveyed in the nip of the image heating apparatus. For example, in a non-steady period, such as a heater rise period, in which the heater temperature is abruptly changed, the heater temperature is required to quickly reach a target temperature while suppressing the overshooting and the undershooting of the target temperature. On the other hand, in a steady period, such as a period (fixing period) in which the recording material is passed through a fixing nip of the image heating apparatus, in which the heater temperature is less changed abruptly, electric power control is required that reduces the degrees of uneven glossiness of an image, non-uniformity of a fixing property and a flicker noise by suppressing a temperature ripple.

Therefore, in each of the above-described periods, there is a need to achieve a balance between the ON-duty and the renewal cycle in a proper range with respect to the electric power supplied to the heater, thereby effecting optimum electric power control.

For example, Japanese Patent No. 3535529 describes an image heating apparatus having a longer control cycle during a temperature rise period than during sheet passing of a material to be heated.

However, a recently developed printer has been required to realize a further reduction in FPOT (first print out time) and high-quality prints using various media compared with those at the time of filing the application for Japanese Patent No. 3535529. Correspondingly, also in this recently developed image heating apparatus, a reduction in the heater rise period and high stability of the heater temperature in the fixing period have been required.

As a result, it has become difficult to set the ON-duty and the control cycle to satisfy both a requirement (overshoot reduction) during the heater rise period and the requirements (reductions of the flicker noise and the temperature ripple) during a relatively steady period, such as the fixing period or the like, even by the constitutions disclosed in Japanese Patent No. 3535529.

SUMMARY OF THE INVENTION

A principal object of the present invention is to provide an image heating apparatus capable of realizing a high-speed temperature rise and image quality improvement by suppressing overshooting and undershooting of a heater temperature with respect to a target temperature in a heater rise period, thereby suppressing a temperature ripple in a fixing period.

According to an aspect of the present invention, there is provided an image heating apparatus for heating a toner image in a nip while conveying a recording material on which the toner image is held, the image heating apparatus comprising: a heater for generating heat by being supplied with electric power from an AC power source; a rotatable heating member for being heated by the heater; a pressing member for forming the nip in contact to the rotatable heating member; a temperature detecting portion for detecting a temperature of the heater or the rotatable heating member; and a controller for setting the electric power supplied to the heater every renewal cycle depending on a detected temperature by the temperature detecting portion, wherein the renewal cycle is shorter in a rise period of the heater than in a period in which the recording material is conveyed in the nip.

According to the present invention, the overshooting and undershooting of the heater temperature with respect to the target temperature can be suppressed in the heater rise period, thereby suppressing the temperature ripple in the fixing period, so that it becomes possible to realize the high-speed temperature rise of the image heating apparatus and the image quality improvement.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

Hereinbelow, Embodiment 1 of the present invention will be described with reference to the drawings.

Figure 2:
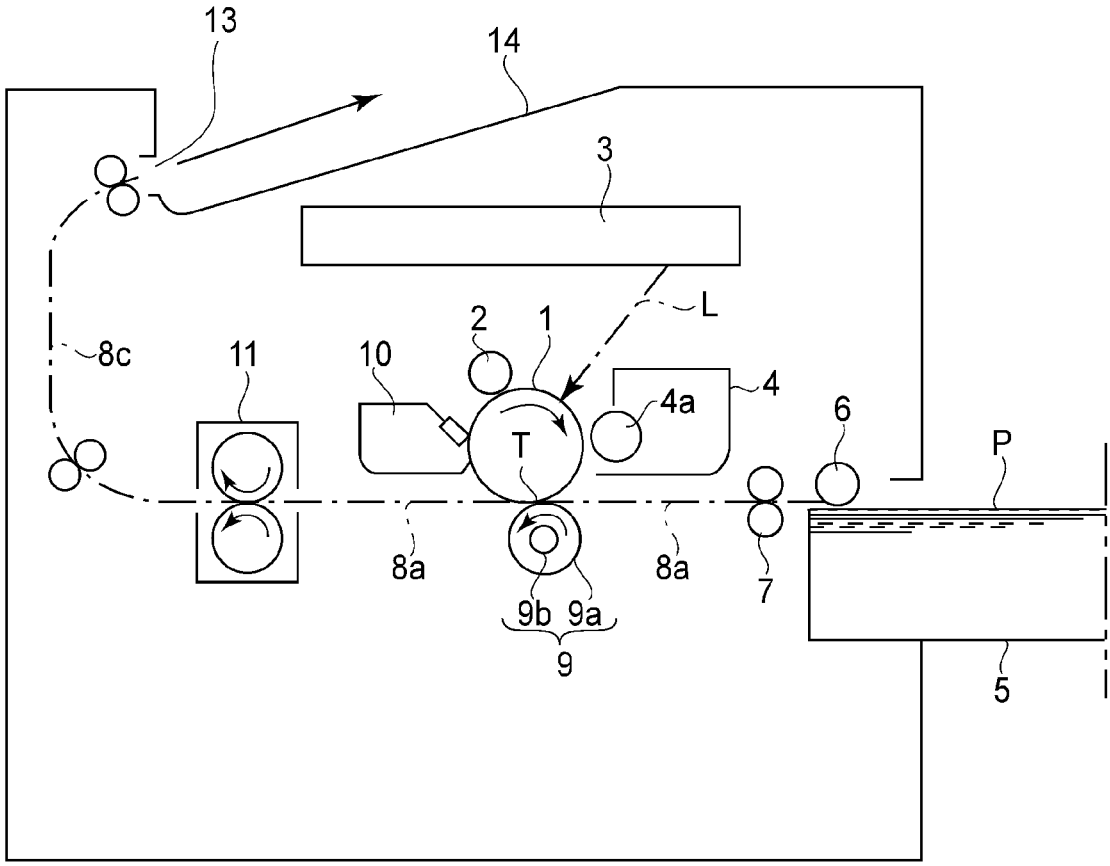
FIG. 2 is an illustration of a principal part of a laser beam printer according to embodiments of the present invention.

FIG. 2 is a schematic illustration of an image forming apparatus according to this embodiment. The image forming apparatus in this embodiment is a laser beam printer of an electrophotographic type. In this embodiment, a description will be provided by taking, as an example, a constitution in which a process speed is about 200 m/sec, a FPOT is about 6 sec, and a throughput (during use of an A4-sized recording material) is about 33 ppm.

An electrophotographic photosensitive (member) drum 1 as an image bearing member is rotationally driven in the clockwise direction indicated by an arrow at a predetermined peripheral speed (process speed).

A contact charging roller 2 as a charging means electrically charges the surface of the photosensitive drum 1 uniformly to a predetermined polarity and a predetermined potential (primary charging).

A laser beam scanner 3 as an image exposure means outputs laser light L, which has been subjected to ON/OFF modulation corresponding to image information inputted from an unshown external device such as a host computer. The charged surface of the photosensitive drum 1 is subjected to scanning exposure with the laser light L. By this scanning exposure, charges at an exposure light portion on the surface of the photosensitive drum 1 are removed, so that an electrostatic latent image corresponding to the image information is formed on the surface of the photosensitive drum 1.

A developing device 4 sequentially develops the electrostatic image on the photosensitive drum 1 into a toner image as a transferable image by supplying a developer from a developing sleeve 4*a* to the photosensitive drum 1. In the case of the laser beam printer, in general, a reverse development type in which the toner is deposited on the exposure light portion of the electrostatic latent image is used.

In a sheet feeding cassette 5, sheets of a recording material P are stacked and accommodated. A sheet feeding roller 6 is driven on the basis of a sheet feeding start signal, so that the sheets of the recording material P in the sheet feeding cassette 5 are separated and fed one by one. The fed recording material P passes through registration rollers 7 and a sheet path 8*a* and is guided into a transfer nip T, with predetermined timing, which is formed between the photosensitive drum 1 and a transfer roller 9 as a transfer member contacting the photosensitive drum 1. That is, conveyance timing or conveyance speed of the recording material P is controlled by the registration rollers 7 with timing such that a leading end portion of a toner image transfer region of the recording material P just reaches the transfer nip T when a leading end portion of a toner image forming region on the photosensitive drum 1 reaches the transfer nip T.

The recording material P guided to the transfer nip T is nip-conveyed through the transfer nip T. During the nip-conveyance, to the transfer portion 9, a predetermined transfer bias is applied from an unshown transfer bias application voltage source. Control of transfer roller 9 and the transfer bias will be described later. The transfer bias of the polarity opposite from the charge polarity of the toner is applied to the transfer roller 9, in the transfer nip T, the toner image on the photosensitive drum 1 is electrostatically transferred onto the surface of the recording material P.

The recording material P on which the toner image has been transferred in the transfer nip T is separated from the photosensitive drum 1 and passes through a sheet path 8*a* between the transfer nip T and the image heating apparatus 11, to be conveyed and guided into the image heating apparatus 11, and then the toner image is fixed on the recording material P.

On the other hand, the photosensitive drum 1 after the recording material P is separated is subjected to removal of untransferred toner, paper dust or the like by a cleaning device 10, so that the photosensitive drum 1 is subjected to image formation.

The recording material P, which has passed through the image heating apparatus 11, is guided along sheet path 8*c* and then is discharged through a sheet discharge opening 13 onto a sheet discharge tray 14.

As the transfer roller 9, in general, a roller including a metal core of stainless steel, Fe (iron) or the like and an elastic layer, which is formed on the metal core, is used. As the elastic layer, a semiconductive sponge adjusted to have a resistance of $1\times10^{6}\Omega$ to $1\times10^{10}\Omega$ by carbon black, ion-conductive filler or the like is used. In this embodiment, an ion-conductive transfer roller prepared by molding an elastic layer 9*a* having electroconductivity formed by reaction of NBR rubber with a surfactant or the like, outside a stainless steel-made core metal 9*b* is used. Further, the elastic layer 9*a* has a resistance value in a range from $1\times10^{8}$ to $5\times10^{8}\Omega$.

It has been known that the resistance value of the transfer roller is liable to fluctuate depending on the temperature and the humidity in an environment in which the image heating apparatus is placed. This fluctuation of the resistance value of the transfer roller can cause an occurrence of improper transfer, paper trace and the like. Therefore, in order to prevent the occurrence of the improper transfer, the paper trace and the like due to the resistance value fluctuation of the transfer roller, applied transfer voltage control is employed, such that the resistance value of the transfer roller is measured and depending on a result of measurement of the resistance value, a transfer voltage applied to the transfer roller is properly controlled.

As an example of the applied transfer voltage control, there is ATVC (active transfer voltage control) disclosed in Japanese Laid-Open Application (JP-A) Hei 2-123385. The ATVC is a means for optimizing the transfer bias applied to the transfer roller during transfer, and by the ATVC, it is possible to prevent the occurrence of the improper transfer and the paper trace. During pre-rotation of the image forming apparatus (during non-sheet-passing), a desired constant-current bias is applied to the photosensitive drum through the transfer roller, and then the resistance value of the transfer roller is detected from the bias value at that time, so that a transfer bias depending on the resistance value is determined. The transfer bias is applied to the transfer roller during the transfer in the printing process. Also in this embodiment, the above-described ATVC was used.

Next, the image heating apparatus 11 in this embodiment will be described. In this embodiment, as an example of the image heating apparatus 11, the image heating apparatus of the film heating type will be described.

Figure 1:
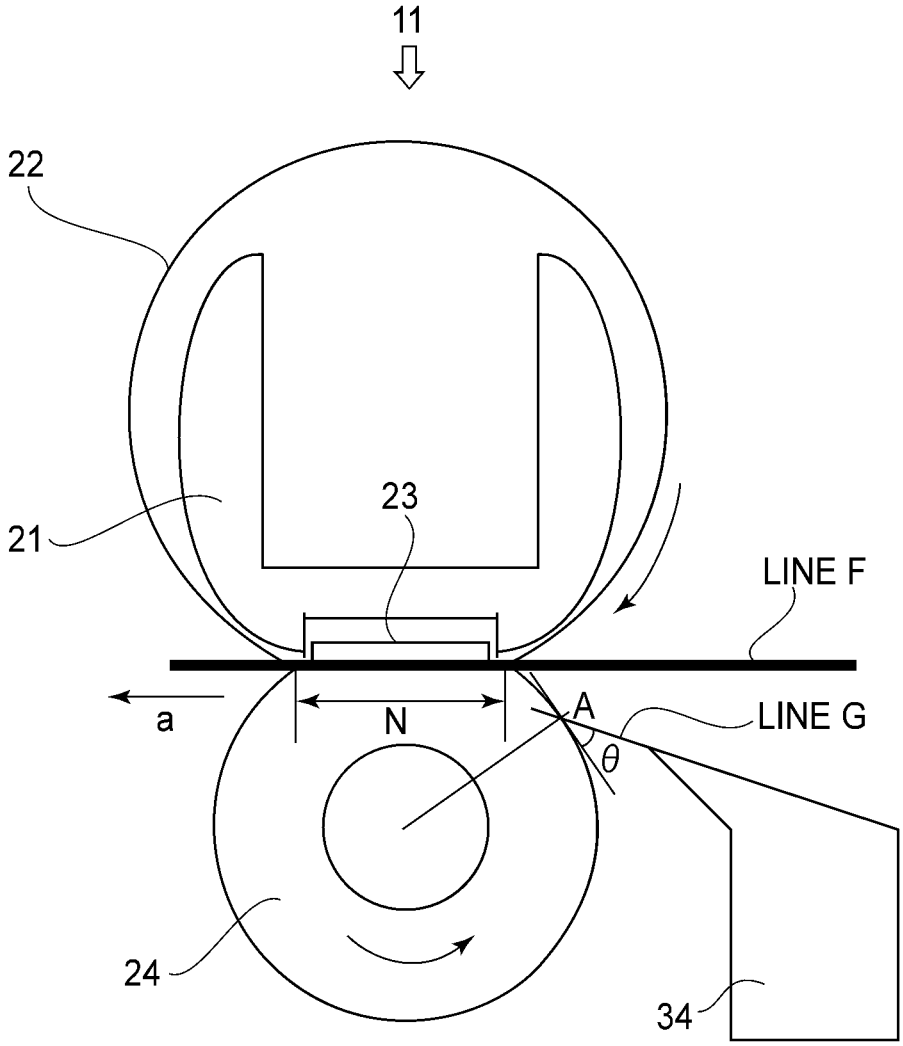
FIG. 1 is an illustration of an image heating apparatus.

FIG. 1 is a schematic illustration of the image heating apparatus 11 of the film heating type in this embodiment. This film heating type image heating apparatus of a tension-less type uses a heat-resistant film having an endless belt shape and a cylindrical shape. At least a part of a circumferential portion of this film is always in a state in which no tension is applied, so that the film is rotationally driven by a rotational driving force of the pressing member.

The image heating apparatus 11 includes a stay 21, a film 22 and a heater 23.

The stay 21 has the function of a member for holding the heater 23 and the function of a member for guiding the film 22 and is a high heat-resistant and high rigidity member.

The heater is provided on a lower surface of the stay 21 along a longitudinal direction of the stay 21. The film 22 is externally engaged with the stay 21. An inner peripheral length of this film 22 is longer than an outer peripheral length of the stay 21 by about 3 mm.

The stay 21 is constituted by high heat-resistant resin materials such as polyimide, polyamideimide, PEEK (polyether ether ketone), PPS (polyphenylene surface) and a liquid crystal polymer, and by composite materials of these resin materials with ceramics, metal, glass and the like. In this embodiment, the liquid crystal polymer was used.

As the film 22, a single-layer film of PTFE (polytetrafluoroethylene), PFA (tetrafluoroethylene-perfluoroalkylvinylether copolymer), FEP (tetrafluoroethylene-hexafluoropropylene copolymer) or the like is used. Further, a composite layer film prepared by coating the film of PTFE, PFA, FEP or the like on the outer peripheral surface of the film of polyimide, polyamideimide, PEEK, PES (polyether sulfone), PPS or the like can be used. The film thickness may preferably be 100 μm or less, and may further preferably be 70 μm or less and 20 μm or more, in order to improve a quick start property of the heating apparatus 11 by decreasing its thermal capacity. In this embodiment, the composite film prepared by coating the film of PTFE on the outer peripheral surface of an about 50μ-thick polyimide film was used. The outer diameter of the film 22 was 18 mm.

A pressing roller 24 as the pressing member opposes the heater 23 via the film 22 and forms a fixing nip N between itself and the film 22, and rotationally drives the film 22. This pressing roller 24 includes a metal core, an elastic layer formed outside the metal core and a parting layer formed outside the elastic layer. The pressing roller 24 is provided in press-contact with the surface of the film 22, contacted to the heater 23, with a predetermined urging force. In this embodiment, the metal core of aluminum, the elastic layer of silicone rubber and the parting layer of PFA tube formed in a thickness of about 30 μm were used. The outer diameter of the pressing roller 24 was 20 mm, and the thickness of the elastic layer was 3.5 mm.

This pressing roller 24 is rotationally driven in an arrow direction at a predetermined peripheral speed by an unshown driving member. By the rotational driving of this pressing roller 24, a rotational force acts on the film 22 through a frictional force between the pressing roller 24 and the outer surface of the film 22 in the fixing nip N. By this rotational force, the film 22 is rotated around the stay 21 by the rotation of the pressing roller 24 in an arrow direction at a peripheral speed substantially equal to the rotational peripheral speed of the pressing roller 24 while hermetically sliding on the surface of the heater 23 in the fixing nip N at its inner surface side.

Figure 3:
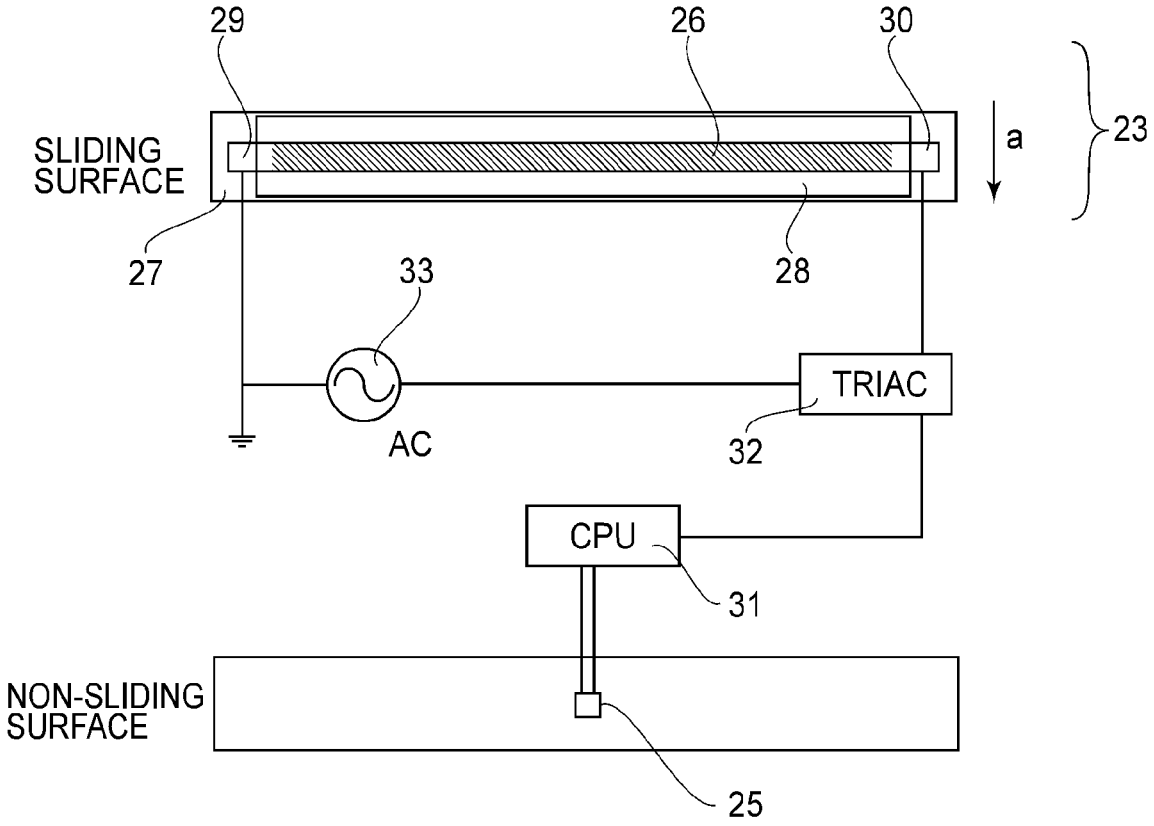
FIG. 3 is a schematic view including a front view of a heating member and showing a circuit for effecting energization control.

FIG. 3 includes a front view of the heater 23 in this embodiment and a circuit diagram of energization. The heater 23 includes a substrate 27, a heat generating resistor 26, a heat-resistant overcoat layer 28, and energizing electrodes 29 and 30. The substrate 27 has an elongated shape in a longitudinal direction, which is a direction perpendicular to a conveyance direction a of the recording material P, and has a heat-resistant property, an insulating property and a good thermo-conductive property. The heat generating resistor 26 is formed along the longitudinal direction on the surface of the substrate 27 sliding with the film 22. The heat-resistant overcoat layer 28 is formed to protect the surface of the heater 23 on which the heat generating resistor 26 is formed. The energizing electrodes 29 and 30 are provided at end portions of the heat generating resistor 26 with respect to the longitudinal direction. The heat generating resistor 26 in this embodiment is formed in a band-like shape on the substrate 27 by screen printing using a paste prepared by kneading silver, palladium, glass powder (inorganic binder) and an organic binder. As a material for the heat generating resistor 26, in place of the silver palladium (Ag/Pd), it is possible to use an electric resistance material such as $RuO_2$ (ruthenium oxide) or $Ta_2N$. The resistance value of the heat generating resistor 26 was 48.4Ω at normal temperature.

As a material for the substrate 27, a ceramics material such as alumina or aluminum nitride is used. In this embodiment, an alumina substrate of 7 mm in width, 270 mm in length and 1 mm in thickness is used. The energizing electrodes 29 and 30 were formed in a screen printing pattern of silver-palladium. A purpose of providing the overcoat layer 28 for coating the heat generating resistor 26 is to ensure an electrically insulating property between the heat generating resistor 26 and the surface of the heater and a sliding property with the film 22. In this embodiment, as the overcoat layer 28, an about 50 μm-thick heat-resistant glass layer was used.

FIG. 3 is a schematic view showing a sliding surface of the heater 23 with the film 22 and a surface opposite from the sliding surface (hereinafter the surface is referred to as a back surface). On the back surface of the heater 23, a temperature detecting portion 25 for detecting the temperature of the heater 23 is provided. In this embodiment, as the temperature detecting portion 25, a thermistor of the type in which the thermistor is externally contacted to the heater 23 is used. This thermistor 25 is constituted by a temperature detecting element and a supporting member for supporting the temperature detecting element and is prepared by providing a heat insulating layer on the supporting and by fixing the temperature detecting element on the heat insulating layer. Further, the thermistor 25 is contacted to the back surface of the heater with the temperature detecting element downward (toward the back surface of the heater) under predetermined pressure. In this embodiment, the thermistor 25 using a heat-resistant liquid crystal polymer as the supporting member and using a ceramics paper as the heat insulating layer was used. The thermistor 25 is provided in a sheet passing region, of the heater 23, for a minimum-sided recording material conveyable by the image heating apparatus. Further, the thermistor 25 is connected to a CPU 31. Incidentally, in place of the constitution in which the temperature of the heater 23 is detected by the thermistor 25, a constitution in which the temperature of the film 22 is detected by the thermistor 25 may also be used.

The heater 23 is exposed and held on the stay 23 with the surface, where the overcoat layer 28 is formed, directed downward.

The image heating apparatus in this embodiment can have, by employing the above-described constitution, a low thermal capacity as a whole compared with the image heating apparatus of the heating roller type, so that it becomes possible to realize a quick start property.

When energization of the energizing electrodes 29 and 30 of the heater 23 is performed, the heat generating resistor generates heat over its full length with respect to the longitudinal direction to be increased in temperature. This temperature rise is detected by the thermistor 25 and output information of the thermistor 25 is A/D converted and is inputted into the CPU 31. The CPU 31 controls, on the basis of this output information, electric power supplied from a triac 32 to the heat generating resistor 26 by the phase control, the image number control or the like, thus controlling the electric power supplied to the heater 23. That is, the energization is controlled so that the heater 23 is increased in temperature when the detected temperature by the thermistor 25 is lower than the target temperature and is decreased in temperature when the detected temperature is higher than the target temperature, so that the heater 23 is kept at the target temperature. The resistance value of the heater 23 used in this embodiment is 48.4Ω. Therefore, in the case where a voltage of 220 V is applied to the heater 23, the electric power in the range of 0 W to 1000 W is supplied to the heater 23.

By the above-described control of the electric power supplied to the heater 23, the temperature of the heater 23 rises to the target temperature and in a steady state of the rotational speed of the film 22 by the rotation of the pressing roller 24, the recording material P conveyed from the transfer portion is guided into the fixing nip N. Then, the recording material P is nip-conveyed together with the film 22 in the fixing nip N, so that the heat of the heater 23 is applied to the recording material P via the film 22 and thus an unfixed toner image is fixed on the surface of the recording material P. The recording material P having passed through the fixing nip N is separated from the surface of the film 22 and is conveyed.

Next, the electric power control of the heater 23 in this embodiment will be described. In this embodiment, as an example of the electric power control, the PI control (proportional integral control) will be described. In the PI control, a proportional control and an integral control are combined depending on an output value from an object to be controlled to determine a control value.

An ON-duty used in the PI control in this embodiment uses a half-wave as a minimum unit and uses a group of a predetermined number of half-waves as one cycle (period). The ON-duty can be set at a plurality of levels depending on the ON/OFF energization ratio of every half-wave. Incidentally, in this embodiment, the electric power control is described based on the PI control but the present invention is not limited thereto. As the electric power control, PID control (proportional integral and differential control) including a differential control may also be used.

In the PI control, a proper ON-duty (electric power level) is fed back, depending on the detected temperature by the thermistor 25. Smoothness of the ON-duty level and responsiveness of the feed-back of the ON-duty provides a trade-off relationship. Therefore, in this embodiment, a proper renewal cycle was independently set, depending on a printing operation. For example, in an operation in which the temperature of the heater 23 is abruptly changed as in a heater rise period before the recording material is passed through the fixing nip, the renewal cycle is shortened to set one control image number at 10 half-waves (electric power level at 11 levels) and the renewal cycle at 100 ms (at 50 Hz). As a result, overshooting or undershooting of the temperature of the heater 23 is suppressed, so that degrees of uneven glossiness of the image, non-uniformity of the fixing property and flicker noise can be reduced. On the other hand, in an operation in which the heater temperature change is small as in a period in which the recording material is passed through the fixing nip (hereinafter referred to as a fixing period), the renewal cycle is prolonged to set the one control image number at 20 half-waves (the electric power level at 21 levels) and the renewal cycle at 200 was (at 50 Hz). As a result, a temperature ripple of the heater 23 is suppressed, so that the degrees of the uneven glossiness of the image, the non-uniformity of the fixing property and the flicker noise can be reduced. Thus, a balance between the ON-duty and the length of the renewal cycle is achieved depending on the printing operation, so that high-speed rise of the image heating apparatus and image quality improvement can be realized.

In this embodiment, the electric power control in the rise period of the heater 23 is effected by the following PI control in which 10 half-waves are used as the one control cycle (11 electric power levels, renewal cycle of 100 ms (at 50 Hz)).

$$\begin{aligned} D(t) &= D_P(t) + D_I(t) \\ &= D_P(t-1) + \Delta D_P + D_I(t-1) + \Delta D_I \\ &= D(t-1) + \Delta D_P + \Delta D_I \\ &= D(t-1) + 0.25 \times e(t) + \Delta D_I \end{aligned}$$

D(t): subsequent ON-duty $D_P(t)$: P (proportional control) component of ON-duty $D_I(t)$: I (integral control) component of ON-duty e(t): (target temperature)−(detected temperature by thermistor 25)

$\Delta D_p$: increased or decreased level calculated by 0.25×e(t) every one control cycle (e.g., in case of e(t)=10, 0.25×10=2.5 which is taken as +2 level by dropping its decimal places)

$\Delta D_I$: +1 level when e(t)>0° C. is continued for 6 control cycles and −1 level where e(t)<0° C. is continued for 6 control cycles.

In this embodiment, the electric power control in the fixing period is effected by the following PI control in which 20 half-waves are used as the one control cycle (21 electric power levels, renewal cycle of 200 ms (at 50 Hz)).

$$\begin{aligned} D(t) &= D_P(t) + D_I(t) \\ &= D_P(t-1) + \Delta D_P + D_I(t-1) + \Delta D_I \\ &= D(t-1) + \Delta D_P + \Delta D_I \\ &= D(t-1) + 0.25 \times e(t) + \Delta D_I \end{aligned}$$

D(t): subsequent ON-duty $D_P(t)$: P (proportional control) component of ON-duty $D_I(t)$: I (integral control) component of ON-duty e(t): (target temperature)−(detected temperature by thermistor 25)

$\Delta D_P$: increased or decreased level calculated by 0.5×e(t) every one control cycle (e.g., in case of e(t)=−5, 0.5×(−5)=−2.5 which is taken as −2 level by dropping its decimal places)

$\Delta D_I$: +1 level when e(t)>0° C. is continued for 3 control cycles and −1 level where e(t)<0° C. is continued for 3 control cycles.

In order to show an effect of this embodiment, a comparative experiment, in which this embodiment was compared with Comparative Embodiments, which is described later was conducted. At that time, comparison items are temperature ripples due to overshooting and undershooting of the detected temperature of the heater 23 in the heater rise period and temperature ripples in the fixing period. The temperature ripple in the rise period of the heater 23 is a temperature difference between temperatures during an overshoot and a subsequent undershoot. Further, the temperature ripple in the fixing period represents a maximum value of a temperature difference between the target temperature and each of detected temperatures of the heater 23 when 100 sheets of A4-sized plain paper (basis weight: 80 g/m$^2$) are continuously passed through the image heating apparatus from a cold state (in which the image heating apparatus is cooled). A sheet passing environment is 23° C./50% RH, which is assumed as a normal office environment, and an applied voltage is 220 V.

In Comparative Embodiment 1, the PI control and the renewal cycle are the same between the rise period of the heater 23 and the fixing period. The ON-duty was 20 half-waves as one control cycle, and the electric power level was 0 W to 1000 W which were equally divided into 21 levels. The renewal cycle was 200 ms (at 50 Hz).

In Comparative Embodiment 2, the PI control and the renewal cycle are the same between the rise period of the heater 23 and the fixing period. The ON-duty is 10 half-waves as one control period, and the electric power level was 0 W to 1000 W which were equally divided into 6 levels. The renewal cycle was 100 ms (at 50 Hz).

In Comparative Embodiment 3, the renewal cycle in the fixing period is shorter than that in the heater rise period. The ON-duty in the heater rise period was 20 half-waves as one control period, and the electric power level was 0 W to 1000 W, which were equally divided into 21 levels. The renewal cycle was 200 ms (at 50 Hz). On the other hand, the ON-duty in the fixing period was 10 half-waves as one control period, and the electric power level was 0 W to 1000 W, which were divided into 11 levels. The renewal cycle was 100 ms (at 50 Hz).

Results of this embodiment and the above three Comparative Embodiments are shown in Table 1.

TABLE 1

| | TEMPERATURE RIPPLE | |
|---|---|---|
| EMB. NO. | RISE | SHEET PASSING |
| EMB. 1 | 7° C. | 3° C. |
| COMP. EMB. 1 | 20° C. | 5° C. |
| COMP. EMB. 2 | 7° C. | 7° C. |
| COMP. EMB. 3 | 20° C. | 9° C. |

According to the experiment by the present inventors, as shown in Table 1, it was found that when the renewal cycle is set long in the fixing period as in Comparative Embodiment 1, the feed-back to the electric power control of the heater 23 is delayed and thus the temperature ripple of about 20° C. is generated. Incidentally, the temperature ripple during the temperature rise of the heater 23 also has an influence on the temperature ripple in the fixing period (during the sheet passing) immediately after the heater rise, thus resulting in image defect in some cases. Therefore, the temperature ripple in the heater rise period may preferably be suppressed to 10° C. or less.

Further, according to the experiment by the present inventors, it was found that when the renewal cycle is shortened in the fixing period as in Comparative Embodiment 2, the smoothness of the duty level is lowered, and therefore the temperature of the heater 23 cannot be converged to the target temperature particularly in a state in which the image heating apparatus is warmed, so that the temperature ripple of about 6° C. is generated. Incidentally, it was confirmed that when the temperature ripple in the fixing period exceeds 5° C., the uneven glossiness of the image and the non-uniformity of the fixing property are generated and the flicker noise becomes poor. Particularly, the uneven glossiness is liable to be conspicuous in the case where glossy paper is used as the recording material. Therefore, the temperature ripple in the fixing period may preferably be suppressed to 5° C. or less.

Further, according to an experiment by the present inventors, it was found that when the renewal cycle in the heater rise period is longer than that in the fixing period as in Comparative Embodiment 3, the temperature ripple in both of the heater rise period and the fixing period is large.

This is because in the image heating apparatus as in the image forming apparatus in this embodiment in which FPOT is set at a short time, there is a need to effect the rise of the temperature of the heater 23 in a shorter time than that in a conventional image heating apparatus and thus high responsiveness of the feed-back to the electric power control is more required. Further, in the fixing period, similarly as in Comparative Embodiment 1, the temperature ripple in the rise period of the heater 23 influenced also the temperature ripple in the fixing period immediately after the heater temperature rise.

By employing the constitution in Embodiment 1, even in the heater rise period and the fixing period, it becomes possible to reduce the degrees of the overshooting and undershooting of the temperature of the heater 23 and the temperature ripple. Therefore, the degrees of the uneven glossiness of the image, the non-uniformity of the fixing property and the flicker noise with speed-up of the printer or copying machine can be reduced, so that it becomes possible to realize a high-speed temperature rise of the image heating apparatus and image quality improvement.

Embodiment 2

In this embodiment, the substantially same constitution as that in Embodiment 1 is employed. The difference will be principally described below.

There are various voltage values of commercial power sources depending on countries and regions. For example, the voltage values are 230 V/240 V in England of Europe, 127 V/230 V in Germany, France and the like, 110 V/220 V in China, South Korea and the like of Asia, 120 V in the U.S.A. of North America, and 120 V/240 V in Canada. Therefore, in some cases, for the reason that commonality of image forming apparatuses supplied to individual countries is achieved to realize cost reduction, the image forming apparatuses are narrowed down to two image forming apparatuses consisting of the image forming apparatus with allowable voltages of 100 V to 127 V (100 V-enabled machine) and the image forming apparatus with allowable voltages of 200 V to 240 V (200 V-enabled machine). In both of the 100 V-enabled machine and the 200 V-enabled machine, the resistance value or the like of the heater 23 is set so as to be usable in the associated allowable voltage range. In view of these circumstances, in this embodiment, there is provided a constitution in which the overshooting and undershooting of the temperature of the heater 23 in the heater rise period and the temperature ripple in the fixing period, which are caused due to a voltage fluctuation of each of the image forming apparatuses, are suppressed.

Although a uniform renewal cycle in the electric power control is set by using the period, from the start of the rise of the heater temperature until the detected temperature of the heater 23 reaches the target temperature, as the rise period in Embodiment 1, the renewal cycle in the electric power control is made variable further depending on a rise speed of the heater 23 in Embodiment 1. For example, in the case where the voltage of the commercial power source is high, the electric power supplied to the heater 23 is increased and therefore the rise speed of the heater 23 becomes high. As a result, the overshooting and undershooting of the temperature of the heater 23 in the heater rise period becomes large and therefore the renewal cycle in the electric power control may preferably be shortened. For example, the electric power in the case where the voltage of 240 V is applied to the 200 V-enabled machine is 1.2 times the electric power in the case where the voltage of 220 V is applied and therefore the rise speed of the heater 23 is correspondingly increased. Depending on the change rate of the detected temperature by the thermistor correlated with the rise speed of the heater 23, the renewal cycle in the electric power control is changed, so that the temperature ripple can be reduced, even in the case where the rise speed of the heater 23 varies depending on the voltage fluctuation or the like of the commercial power source.

In this embodiment, a time change of the detected temperature of the heater 23 by the thermistor 25 is detected. Specifically, the difference ΔT between the detected temperature before start of the heater rise and the detected temperature after a lapse of about 1.0 sec from after the start of the heater rise is detected. It is also possible to obtain the temperature change rate of the heater 23. Further, in this embodiment, depending on the detected temperature change rate of the detected temperature of the heater 23, the control cycle (renewal cycle) in the electric power control of the heater 23 is changed. Further, in this embodiment, a threshold (ΔT1) capable of discriminating whether the voltage of the commercial power sources 220 V or 240 V is set in advance and then the difference ΔT and the threshold ΔT1 are compared to thereby discriminate the applied (supplied) electric power.

In the case where the temperature change rate of the heater 23 is smaller than the threshold ΔT1 during the temperature rise of the heater 23, similarly as in Embodiment 1, the PI control is effected by using the 10 half-waves as the one control cycle (11 electric power levels, renewal cycle of 100 ms (at 50 Hz)).

On the other hand, in the case where the temperature change rate of the heater 23 is larger than the threshold ΔT1, the electric power control is effected by the following PI control in which 8 half-waves are used as the one control cycle (9 electric power levels, renewal cycle of 80 ms (at 50 Hz))

$$\begin{aligned} D(t) &= D_P(t) + D_I(t) \\ &= D_P(t-1) + \Delta D_P + D_I(t-1) + \Delta D_I \\ &= D(t-1) + \Delta D_P + \Delta D_I \\ &= D(t-1) + 0.25 \times e(t) + \Delta D_I \end{aligned}$$

D(t): subsequent ON-duty $D_P(t)$: P (proportional control) component of ON-duty $D_I(t)$: I (integral control) component of ON-duty e(t): (target temperature)−(detected temperature by thermistor 25)

$\Delta D_P$: increased or decreased level calculated by 0.20×e(t) every one control cycle (e.g., in case of e(t)=9, 0.20×9=1.8 which is taken as +1 level by dropping its decimal places)

$\Delta D_I$: +1 level when e(t)>0° C. is continued for 8 control cycles and −1 level where e(t)<0° C. is continued for 8 control cycles.

Incidentally, the electric power control in the fixing period is the same as that in Embodiment 1.

In order to show an effect of this embodiment, temperature ripples in Embodiment 1 and in Embodiment 2 in which a commercial power source different in voltage from the commercial power source in Embodiment 1 are compared. Comparison items are the temperature ripples due to the overshooting and undershooting of the detected temperature of the heater 23 in the heater rise period and the temperature ripples in the fixing period, and since they are the same as those in Embodiment 1, a description thereof will be omitted. The experiment environment was 23° C./50% RH, which is assumed to be a normal office environment.

TABLE 2

| | | TEMPERATURE RIPPLE | |
|---|---|---|---|
| EMB. NO. | POWER (VOLTAGE) | RISE | SHEET PASSING |
| EMB. 1 | 220 V | 7° C. | 3° C. |
| | 240 V | 14° C. | 3° C. |
| EMB. 2 | 220 V | 7° C. | 3° C. |
| | 240 V | 9° C. | 3° C. |

According to the experiment by the present inventors, the results of which are shown in Table 2, it is understood that the temperature ripple when the voltage of 240 V is supplied in this embodiment (Embodiment 2) is 9° C. and thus is reduced compared with 14° C. in Embodiment 1. Therefore, even in the case where the supplied electric power is different and thus the rise speed of the heater 23 is different in the constitution of Embodiment 2 as described above, it becomes possible to reduce the degrees of the overshooting and undershooting of the temperature of the heater and the temperature ripple. That is, the degrees of the uneven glossiness of the image, the non-uniformity of the fixing property, and the flicker noise can be reduced.

In this embodiment, although the period from the start of the temperature rise of the heater 23 until the detected temperature of the heater reaches the target temperature is used as the rise period, and the renewal cycle in the electric power control in this rise period is made constant, the renewal cycle in the electric power control may be made variable also in this rise period. For example, a similar effect can be obtained by making the renewal cycle long when the temperature difference between the detected temperature of the heater 23 and the target temperature is large and by making the renewal cycle short when the temperature difference between the detected temperature of the heater 23 and the target temperature is small. In this control, in the rise period, the renewal cycle in the electric power control in the latter half is shorter than that in the first half.

Embodiment 3

This embodiment is different from Embodiment 1 in the following way.

In Embodiment 1, the image number control in which the ON-duty of the heater 23 is controlled by using one half-wave of the commercial power source as a minimum unit is employed, and on the other hand, in this embodiment, combined control of the image number control with phase control of the type in which a phase angle in one half-wave of the commercial power source is controlled is employed.

The combined control of the image number control with the phase control will be described below.

The image number control is, as described above, such that either one of 100% energization or non-energization (0% energization) is effected with respect to one half-wave in a predetermined control cycle. On the other hand, the phase control is such that the ON-duty in the predetermined control cycle is controlled at multiple levels by including an energization angle-controlled waveform in one half-wave in the same control cycle. In this embodiment, the phase control is employed with respect to a part of a plurality of continuous half-waves and the image number control is employed with respect to the remaining part of the continuous half-waves, so that multi-level ON-duty setting is enabled. Herein, such combined control is defined as hybrid control. That is, the hybrid control is, as disclosed in JP-A 2003-123941, basically the image number control using several half-waves as one unit, wherein the phase control is effected with respect to some of the several half-waves. The hybrid control includes the waveform, in the control cycle, for which the phase control is effected and therefore fine ON-duty setting can be made by the waveform, so that the electric power control cycle can be made shorter than that in the case where the ON-duty is controlled by only the image number control.

In this embodiment, the ON-duty control cycle as the renewal cycle in the electric power control is, in the case where an AC power source frequency is 50 Hz, 40 msec in the heater rise period and 80 msec in the fixing period since the heater rise period is 4 half-wave unit and the fixing period is 8 half-wave unit.

For example, in the case where the normal image number control is effected based on the 8 half-wave unit, the ON-duty can only be controlled with an increment of 12.5% and therefore the fluctuation width (range) of the electric power supplied to the heater becomes large. As a result, the temperature ripple of the heater also becomes large, and therefore the uneven glossiness and the fixing property non-uniformity are generated, so that the flicker noise is liable to worsen. On the other hand, in the hybrid control used in this embodiment, some of half-waves for which the phase control is effected are included in the half-waves for which the image number control is effected, so that the ON-duty can be finely set even with respect to the 4 half-wave unit or the 8 half-wave unit and thus the above-described problems can be remedied.

In the hybrid control, the image number (renewal cycle) per unit can be made smaller, but when the image number per unit is made excessively small, the ratio of the phase control is increased as a whole and therefore a harmonic current is increased. Therefore, in this embodiment, 8 half-waves for which the influence of the harmonic current is less were set as the ON-duty renewal cycle. The ON-duty renewal cycle setting is not limited thereto, depending on the constitution of the image heating apparatus.

Incidentally, in the actual electric power control of the heater 23, a waveform pattern of the AC voltage is set every ON-duty in advance and the energization is effected, with the waveform in accordance with each associated pattern, every ON-duty set by the PI control.

The waveform patterns for values of the ON-duty in this embodiment are shown in Tables 3 and 4. In this embodiment, waveform setting (Table 3) of 11 patterns in total using 4 half-waves as the renewal cycle with an ON-duty increment of 10% and waveform setting (Table 4) of 21 patterns in total from 0% to 100% using 8 half-waves as the renewal cycle with the ON-duty increment of 5% are used. Incidentally, the electric power control in Table 3 is used in the heater rise period and the electric power control in Table 4 is used in the fixing period.

TABLE 3

| | 4 HALF-WAVES | | | |
|---|---|---|---|---|
| ON-DUTY | 1ST | 2ND | 3RD | 4TH |
| 0% | 0% | 0% | 0% | 0% |
| 10% | 0% | 20% | 20% | 0% |
| 20% | 0% | 40% | 40% | 0% |
| 30% | 0% | 60% | 60% | 0% |
| 40% | 0% | 80% | 80% | 0% |
| 50% | 0% | 100% | 100% | 0% |
| 60% | 20% | 100% | 100% | 20% |
| 70% | 40% | 100% | 100% | 40% |
| 80% | 60% | 100% | 100% | 60% |
| 90% | 80% | 100% | 100% | 80% |
| 100% | 100% | 100% | 100% | 100% |

TABLE 4

| ON-DUTY | 8 HALF-WAVES (%) | | | | | | | |
|---|---|---|---|---|---|---|---|---|
| (%) | 1ST | 2ND | 3RD | 4TH | 5TH | 6TH | 7TH | 8TH |
| 0 | 0 | 0 | 0 | 0 | 0 | 0 | 0 | 0 |
| 5 | 0 | 0 | 20 | 0 | 0 | 20 | 0 | 0 |
| 10 | 0 | 0 | 40 | 0 | 0 | 40 | 0 | 0 |
| 15 | 0 | 0 | 60 | 0 | 0 | 60 | 0 | 0 |
| 20 | 0 | 0 | 80 | 0 | 0 | 80 | 0 | 0 |
| 25 | 0 | 0 | 100 | 0 | 0 | 100 | 0 | 0 |
| 30 | 20 | 0 | 0 | 100 | 100 | 0 | 0 | 20 |
| 35 | 40 | 0 | 0 | 100 | 100 | 0 | 0 | 40 |
| 40 | 0 | 100 | 0 | 60 | 60 | 0 | 100 | 0 |
| 45 | 0 | 100 | 0 | 80 | 80 | 0 | 100 | 0 |
| 50 | 0 | 100 | 0 | 100 | 100 | 0 | 100 | 0 |
| 55 | 0 | 100 | 100 | 0 | 66 | 54 | 54 | 66 |
| 60 | 100 | 40 | 40 | 100 | 0 | 100 | 100 | 0 |
| 65 | 100 | 60 | 60 | 100 | 0 | 100 | 100 | 0 |
| 70 | 100 | 80 | 80 | 100 | 0 | 100 | 100 | 0 |
| 75 | 100 | 100 | 100 | 100 | 0 | 100 | 100 | 0 |
| 80 | 100 | 100 | 54 | 54 | 100 | 100 | 66 | 66 |
| 85 | 100 | 100 | 64 | 64 | 100 | 100 | 76 | 76 |
| 90 | 100 | 100 | 60 | 60 | 100 | 100 | 100 | 100 |
| 95 | 100 | 100 | 80 | 80 | 100 | 100 | 100 | 100 |
| 100 | 100 | 100 | 100 | 100 | 100 | 100 | 100 | 100 |

As described above, in this embodiment, the electric power control in the heater rise period is effected by the following PI control in which 4 half-waves are used as the one control cycle (11 electric power levels, renewal cycle of 40 ms (at 50 Hz)).

$$\begin{aligned} D(t) &= D_P(t) + D_I(t) \\ &= D_P(t-1) + \Delta D_P + D_I(t-1) + \Delta D_I \\ &= D(t-1) + \Delta D_P + \Delta D_I \\ &= D(t-1) + 0.25 \times e(t) + \Delta D_I \end{aligned}$$

D(t): subsequent ON-duty $D_P(t)$: P (proportional control) component of ON-duty $D_I(t)$: I (integral control) component of ON-duty e(t): (target temperature)−(detected temperature by thermistor 25)

$\Delta D_P$: increased or decreased level calculated by 0.25×e(t) every one control cycle (e.g., in case of e(t)=10, 0.25×10=2.5 which is taken as +2 level by dropping its decimal places)

$\Delta D_I$: +1 level when e(t)>0° C. is continued for 10 control cycles and −1 level where e(t)<0° C. is continued for 10 control cycles.

In this embodiment, the electric power control in the fixing period is effected by the following PI control in which 8 half-waves are used as the one control cycle (21 electric power levels, renewal cycle of 80 ms (at 50 Hz)).

$$\begin{aligned} D(t) &= D_P(t) + D_I(t) \\ &= D_P(t-1) + \Delta D_P + D_I(t-1) + \Delta D_I \\ &= D(t-1) + \Delta D_P + \Delta D_I \\ &= D(t-1) + 0.25 \times e(t) + \Delta D_I \end{aligned}$$

D(t): subsequent ON-duty $D_P$(t): P (proportional control) component of ON-duty $D_I$(t): I (integral control) component of ON-duty e(t): (target temperature)−(detected temperature by thermistor 25)

$\Delta D_P$: increased or decreased level calculated by 0.5×e(t) every one control cycle (e.g., in case of e(t)=−5, 0.5×(−5)=−2.5 which is taken as −2 level by dropping its decimal places)

$\Delta D_I$: +1 level when e(t)>0° C. is continued for 5 control cycles and −1 level where e(t)<0° C. is continued for 5 control cycles.

In order to show an effect of this embodiment, a comparative experiment with the following Comparative Embodiments was conducted.

In Comparative Embodiment 4, the PI control and the renewal cycle are the same between the heater rise period and the fixing period. The ON-duty is 4 half-waves as one control period, and the electric power level was 0 W to 1000 W which were equally divided into 11 levels. The renewal cycle was 40 ms (at 50 Hz).

In Comparative Embodiment 5, the present invention control and the renewal cycle are the same between the heater rise period and the fixing period. The ON-duty in the heater rise period was 8 half-waves as one control period, and the electric power level was 0 W to 1000 W which were equally divided into 21 levels. The renewal cycle was 80 ms (at 50 Hz).

Temperature ripples in Embodiment 3 and in Comparative Embodiments 4 and 5 are compared. Comparison items are the temperature ripples due to the overshooting and undershooting of the detected temperature of the heater 23 in the heater rise period and the temperature ripples in the fixing period, thus being the same as those in Embodiment 1, and therefore a description thereof will be omitted. The sheet passing experiment environment is 23° C./50% RH, which is assumed to be a normal office environment. The supplied voltage is 220 V.

TABLE 5

| | TEMPERATURE RIPPLE | |
|---|---|---|
| EMB. NO. | RISE | SHEET PASSING |
| EMB. 1 | 3° C. | 1° C. |
| COMP. EMB. 4 | 3° C. | 2° C. |
| COMP. EMB. 5 | 5° C. | 1° C. |

According to the experiment by the present inventors, the results of which are shown in Table 5, it was confirmed that by the constitution of this embodiment, the temperature ripple in the heater rise period is 3° C. and the temperature ripple in the fixing period is 1° C., and thus the temperature ripples in this embodiment are better than those in Comparative Embodiments 4 and 5. Therefore, in the constitution of this embodiment, it becomes possible to reduce the degrees of the overshooting and undershooting of the temperature of the heater and the temperature ripple. As a result, the degrees of the uneven glossiness of the image, the non-uniformity of the fixing property and the flicker noise are reduced, so that the high-speed rise of the image heating apparatus and image quality improvement can be realized.

In Embodiments 1 to 3, the PI control is effected by supplying offset electric power, depending on the target temperature at the time of the start of the temperature rise of the heater 23. In order to further shorten the heater temperature rise time, it would also be considered that the heater is caused to rise with maximum electric power or first offset electric power smaller than the maximum electric power at the time of the start of the temperature rise of the heater 23. In this case, when the heater 23 is turned on with the maximum electric power or the first offset electric power until immediately before the detected temperature of the heater 23 reaches the target temperature, there is a high possibility that the detected temperature overshoots the target temperature. Therefore, a rising method of the heater 23 such that the heater 23 is turned on with the maximum electric power or the first offset electric power until a temperature (ready temperature) lower than the target temperature and second offset electric power smaller than the first offset electric power is set at the time when the heater temperature reaches the ready temperature and the electric power control goes to the PI control would be considered. By using such a rising method, the heater temperature rise time can be shortened and the temperature ripple can be further reduced. In this case, the first offset electric power and the second offset electric power are set at optimum values, depending on a degree of warming of the image heating apparatus, so that the temperature ripple can be further reduced. For example, a constitution in which the first offset electric power and the second offset electric power are changed, depending on an output value of the thermistor or the like, which reflects a temperature state of the image heating apparatus, would be considered.

Further, in Embodiments 1 to 3, although the period from the start of the temperature rise of the heater 23 until the detected temperature of the heater reaches the target temperature is used as the rise period and the renewal cycle in the electric power control is made constant, it would be considered that this renewal cycle is made variable. For example, in some cases, the rise time of the heater 23 is shortened to enable further reduction of the temperature ripple by making the renewal cycle long when the temperature difference between the detected temperature of the heater 23 and the target temperature is large and by making the renewal cycle short when the temperature difference is small. This electric power control is such that in the rise period, the control renewal cycle in the latter half is shorter than that in the first half. Further, the electric power control in the rise period of the heater 29 in this embodiment is not limited to that in the rise period, but is applicable to the case where there is the temperature difference between the detected temperature of the heater 23 and the target temperature. For example, the electric power control is applicable when in an interval period in the fixing nip between the current recording material and a subsequent recording material, the target temperature of the heater 23 is made lower than the target temperature in the fixing period and then is caused to rise to the target temperature in the fixing period until the subsequent recording material reaches the fixing nip.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 112763/2011 filed May 19, 2011, which is hereby incorporated by reference.

What is claimed is:

1. An image heating apparatus for heating a toner image in a nip while conveying a recording material on which the toner image is held, said image heating apparatus comprising:

a heater configured to generate heat by being supplied with electric power from an AC power source;

a rotatable heating member configured to be heated by said heater;

a pressing member configured to form the nip in contact to said rotatable heating member;

a temperature detecting portion configured to detect a temperature of said heater or said rotatable heating member; and a controller configured to set the electric power supplied to said heater every renewal cycle depending on a detected temperature by said temperature detecting portion, wherein the renewal cycle is shorter in a rise period of said heater than in a period in which the recording material is conveyed in the nip.

2. An image heating apparatus according to claim 1, wherein a waveform supplied to said heater is formed by image number control in which whether or not the waveform is supplied is controlled every half-wave.

3. An image heating apparatus according to claim 2, wherein in the rise period of said heater, the renewal cycle varies depending on the temperature difference between a target temperature and the detected temperature by said temperature detecting portion.

4. An image heating apparatus according to claim 1, wherein said rotatable heating member is a cylindrical film, wherein said heater contacts an inner surface of the film, and wherein the nip is formed between said pressing member and the film which said heater contacts.

* * * * *

UNITED STATES PATENT AND TRADEMARK OFFICE

CERTIFICATE OF CORRECTION

PATENT NO. : 8,755,705 B2
APPLICATION NO. : 13/471927
DATED : June 17, 2014
INVENTOR(S) : Hisashi Nakahara and Kentaro Yamashita It is certified that error appears in the above-identified patent and that said Letters Patent is hereby corrected as shown below:

ON THE TITLE PAGE:

Please correct the Assignee name as follows:

(73) ASSIGNEE:

"Cannon Kabushiki Kaisha" should read --Canon Kabushiki Kaisha--

Signed and Sealed this
Fifth Day of May, 2015

Michelle K. Lee

Michelle K. Lee
*Director of the United States Patent and Trademark Office*